US012339081B2

(12) United States Patent
Bender

(10) Patent No.: US 12,339,081 B2
(45) Date of Patent: Jun. 24, 2025

(54) AK FIRE CONTROL MECHANISM

(71) Applicant: In Ovation LLC, Vadnais Heights, MN (US)

(72) Inventor: Terrence D. Bender, Minneapolis, MN (US)

(73) Assignee: In Ovation LLC, Vadnais Heights, MN (US)

( * ) Notice: Subject to any disclaimer, the term of this patent is extended or adjusted under 35 U.S.C. 154(b) by 0 days.

(21) Appl. No.: 17/702,354

(22) Filed: Mar. 23, 2022

(65) Prior Publication Data

US 2022/0307788 A1 Sep. 29, 2022

Related U.S. Application Data

(60) Provisional application No. 63/165,110, filed on Mar. 23, 2021.

(51) Int. Cl.
*F41A 19/43* (2006.01)
*F41A 17/46* (2006.01)

(52) U.S. Cl.
CPC ..... *F41A 19/43* (2013.01); *F41A 17/46* (2013.01)

(58) Field of Classification Search
CPC ..... F41A 19/43; F41A 17/46
See application file for complete search history.

(56) References Cited

U.S. PATENT DOCUMENTS 4,310,981 A 1/1982 Waddell
5,463,829 A 11/1995 Sprangers
5,501,134 A 3/1996 Milazzo et al.
5,623,114 A 4/1997 Soper
5,881,485 A 3/1999 Milazzo
5,904,132 A 5/1999 Biller
6,131,324 A 10/2000 Jewell
6,615,527 B1 9/2003 Martin
6,722,072 B1 4/2004 McCormick
6,772,548 B1 8/2004 Power
7,162,824 B1 1/2007 McCormick
7,188,561 B1 3/2007 Kelbly
7,293,385 B2 11/2007 McCormick
7,331,136 B2 2/2008 Geissele
7,600,338 B2 10/2009 Geissele
7,661,220 B2 2/2010 Crandall et al.
7,854,084 B1 12/2010 Rutherford
8,069,602 B2 12/2011 Geissele
8,572,880 B2 11/2013 Bender
8,985,006 B1 * 3/2015 Christensen ..... F41A 17/46 89/142
9,557,128 B2 * 1/2017 Miller, III ..... F41A 17/46
9,618,288 B2 4/2017 Wilson
9,696,103 B2 7/2017 Bender
(Continued)

FOREIGN PATENT DOCUMENTS

DE 102006048436 A1 2/2008

*Primary Examiner* — Michelle Clement
(74) *Attorney, Agent, or Firm* — Laabs Intellectual Property

(57) ABSTRACT

In some embodiments, a fire control mechanism comprises a hammer, a trigger and a safety. The hammer is rotatable about a hammer axis. The trigger is rotatable about a trigger axis and arranged to contact the hammer. The safety is arranged to interfere with rotation of the trigger. The safety comprises a second portion moveable with respect to a first portion.

20 Claims, 13 Drawing Sheets

(56) References Cited

U.S. PATENT DOCUMENTS

| | | | | |
|---|---|---|---|---|
| 9,869,522 | B2 * | 1/2018 | Larson, Jr. | F41A 19/16 |
| 10,006,733 | B2 | 6/2018 | Bender | |
| 10,670,367 | B1 * | 6/2020 | Boyer | F41A 35/06 |
| 10,837,728 | B2 | 11/2020 | Olson et al. | |
| 10,948,252 | B1 | 3/2021 | Bender | |
| 11,085,720 | B2 * | 8/2021 | Nguyen | F41A 19/46 |
| 2006/0086031 | A1 | 4/2006 | Geissele | |
| 2007/0266845 | A1 | 11/2007 | Polston | |
| 2008/0010889 | A1 | 1/2008 | Metzger et al. | |
| 2009/0183414 | A1 | 7/2009 | Geissele | |
| 2010/0281739 | A1 | 11/2010 | Geissele | |
| 2011/0167696 | A1 * | 7/2011 | Gangl | F41A 19/14<br>42/108 |
| 2016/0131449 | A1 | 5/2016 | Horch | |
| 2018/0100712 | A1 * | 4/2018 | Tompkins | F41A 19/15 |
| 2023/0349655 | A1 * | 11/2023 | Balhan | F41A 17/34 |

* cited by examiner

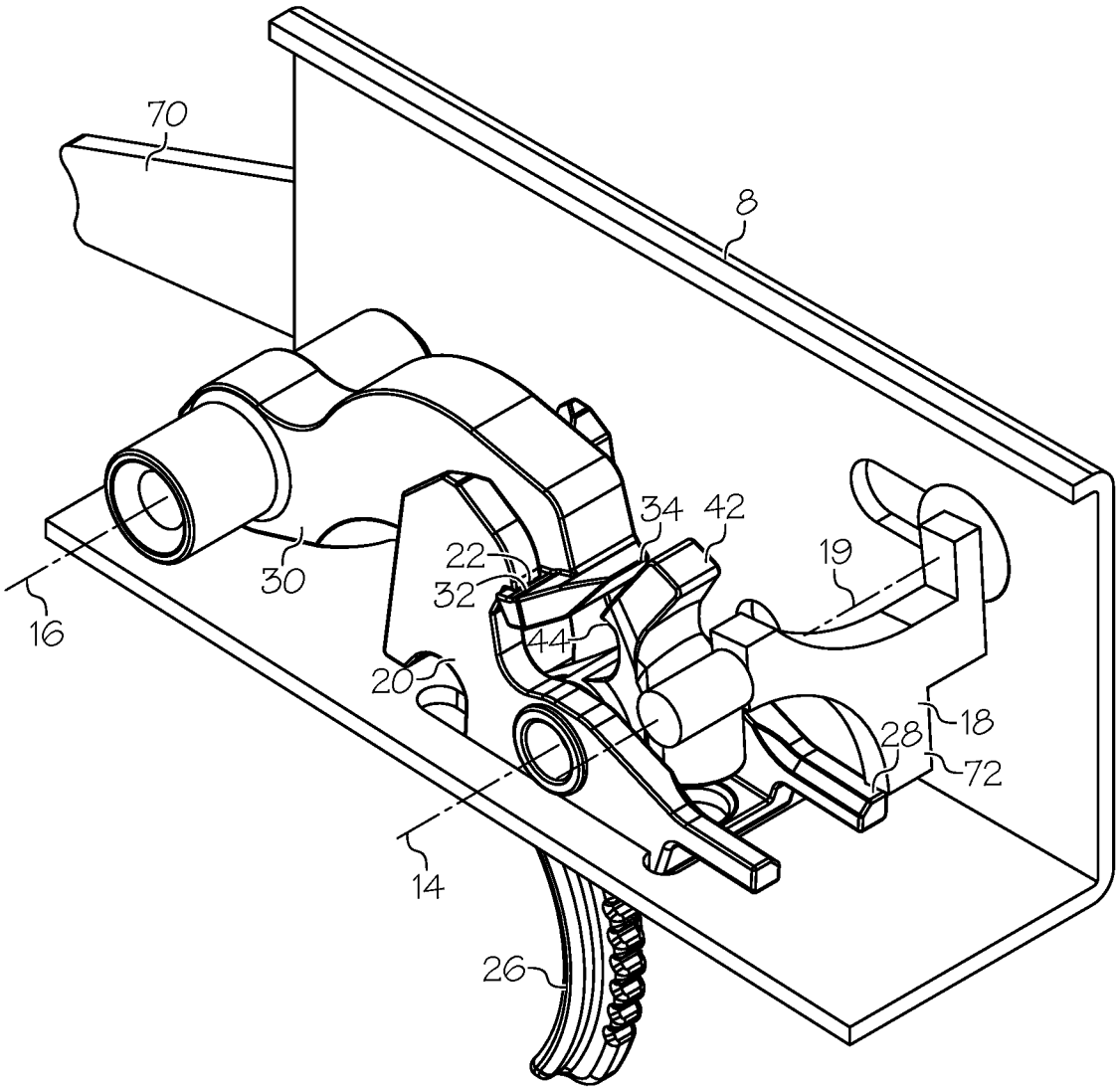
FIG. 1
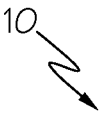

AK FIRE CONTROL MECHANISM

CROSS-REFERENCE TO RELATED APPLICATIONS

This application claims the benefit of U.S. Patent Application No. 63/165,110, filed Mar. 23, 2021, the entire content of which is hereby incorporated herein by reference.

BACKGROUND OF THE INVENTION

This invention relates to fire control mechanisms, for example as may be included in rifles and other firearms.

Precision, accuracy and controllability are desirable in a fire control mechanism. Higher quality fire control systems allow a shooter to better engage a target.

There remains a need for novel fire control arrangements that provide benefits over prior fire control mechanisms.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a fire control mechanism comprises a hammer, a trigger and a safety. The hammer is rotatable about a hammer axis. The trigger is rotatable about a trigger axis and arranged to contact the hammer. The safety is arranged to interfere with rotation of the trigger. The safety comprises a second portion moveable with respect to a first portion.

In some embodiments, the safety is arranged to rotate about a safety axis.

In some embodiments, a distance between the safety axis and the second portion changes as the second portion is moved with respect to the first portion.

In some embodiments, the second portion comprises screw threads. In some embodiments, the first portion comprises a threaded cavity. In some embodiments, the second portion comprises a set screw.

In some embodiments, the first portion comprises a bore providing access to the second portion.

In some embodiments, a fire control mechanism comprises a hammer, a trigger and a safety. The hammer is rotatable about a hammer axis. The trigger is rotatable about a trigger axis and arranged to contact the hammer. The safety is arranged to interfere with rotation of the trigger. The safety comprises a supported portion and a bevel adjacent to the supported portion.

In some embodiments, the bevel comprises a cross-section smaller than a cross-section of the supported portion.

In some embodiments, the supported portion and the bevel share an edge.

In some embodiments, the safety comprises a flange adjacent to the supported portion. In some embodiments, the flange comprises a cross-section larger than a cross-section of the supported portion. In some embodiments, the bevel and the flange are located on opposite sides of the supported portion.

In some embodiments, the supported portion comprises a first supported portion, and the safety comprises a second supported portion and a second bevel adjacent to the second supported portion.

In some embodiments, a housing is arranged to support the first supported portion and the second supported portion. In some embodiments, the second bevel is oriented outside the housing.

In some embodiments, fire control mechanism comprises a hammer, a trigger, a disconnector and a trigger pin. The hammer is rotatable about a hammer axis. The trigger is rotatable about a trigger axis and arranged to contact the hammer. The disconnector is rotatable about the trigger axis. The trigger pin is arranged to support the trigger and the disconnector. The trigger pin comprises a bevel.

In some embodiments, the bevel is located at an end of the trigger pin. In some embodiments, the trigger pin is supported by a housing and the bevel extends outside of the housing.

In some embodiments, the trigger pin contacts the trigger. In some embodiments, the trigger pin contacts the disconnector.

In some embodiments, the trigger comprises a bevel.

In some embodiments, the disconnector comprises a bevel.

In some embodiments, a fire control mechanism comprises a hammer rotatable about a hammer axis and a trigger rotatable about a trigger axis. The trigger is arranged to contact the hammer. The trigger comprises a trigger sear and a ramp adjacent to the trigger sear. An angle between the ramp and the trigger sear is less than 120 degrees.

In some embodiments, the angle is less than 115 degrees. In some embodiments, the angle is less than 110 degrees.

In some embodiments, the trigger sear is flat and the ramp is flat.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

FIG. 1 shows an embodiment of a fire control mechanism.

DETAILED DESCRIPTION OF THE INVENTION

Figure 2:
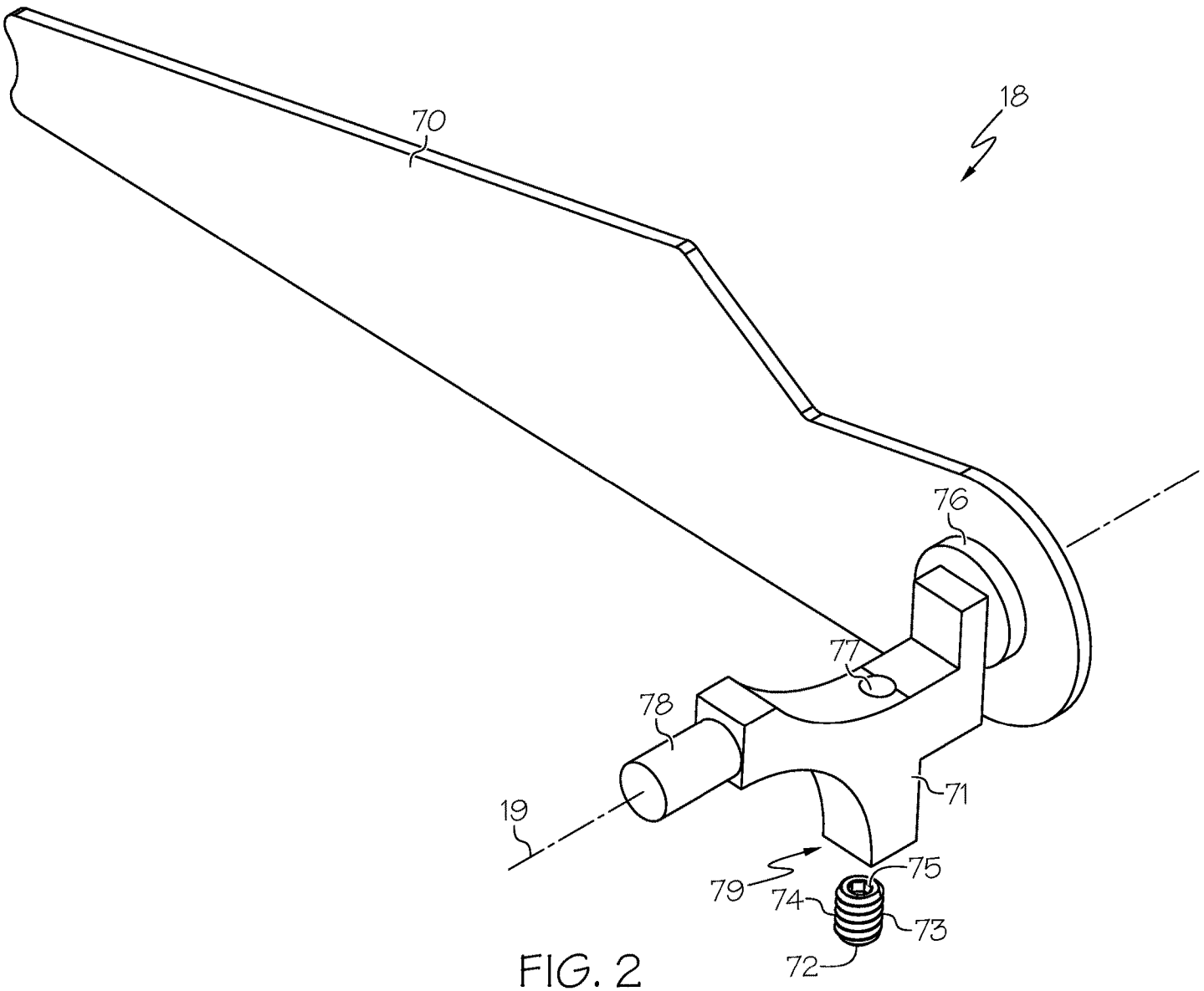
FIG. 2 shows an embodiment of a safety mechanism.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a fire control mechanism 10. In some embodiments, a fire control mechanism 10 comprises a portion of a firearm. In some embodiments, a fire control mechanism 10 is contained in a housing 8 of a firearm, such as a receiver. In some embodiments, a fire control mechanism 10 is arranged for use in an AK-style firearm, such as an AK-47, and is configured to be received in an AK receiver.

In some embodiments, a fire control mechanism 10 comprises a trigger 20 and a hammer 30. In some embodiments, a fire control mechanism 10 comprises a disconnector 42. In some embodiments, a fire control mechanism 10 comprises a safety mechanism 18.

In some embodiments, the trigger 20 is arranged to rotate about a trigger axis 14 and is biased in a first rotational direction (e.g. clockwise) by a trigger spring (not shown). In some embodiments, the trigger 20 comprises a finger bow 26 and a force applied to the finger bow 26 can bias the trigger 20 in a second rotational direction (e.g. counter-clockwise), opposite that of the trigger spring.

In some embodiments, the hammer 30 is arranged to rotate about a hammer axis 16 and is biased in a second rotational direction (e.g. counter-clockwise) by a hammer spring (not shown). In some embodiments, the hammer 30 and the trigger 20 contact one another and the trigger 20 is arranged to prevent the hammer 30 from moving. In some embodiments, the hammer 30 comprises a hammer sear 32 and the trigger 20 comprises a trigger sear 22. In some embodiments, the trigger sear 22 contacts the hammer sear 32, wherein the trigger 20 prevents the hammer 30 from "falling." As a shooter applies a force to the finger bow 26 of the trigger 20, the trigger 20 is rotated in the second rotational direction (e.g. counter-clockwise), causing the trigger sear 22 to slide against the hammer sear 32. This sliding engagement between the sears 22, 32 is generally referred to as "creep." When the trigger 20 has rotated enough that the trigger sear 22 clears the hammer sear 32, the hammer 30 falls—this is generally referred to as "break." The hammer 30 then falls, typically striking a firing pin and firing a round.

In some embodiments, the fire control mechanism 10 comprises a disconnector 42. In some embodiments, a disconnector 42 is arranged to engage the hammer 30 as the hammer 30 is being reset subsequent to a firing sequence, and the disconnector 42 prevents the firearm from firing a subsequent round. In some embodiments, a disconnector 42 is arranged to pivot about the trigger axis 14 and is also moveable with respect to the trigger 20. In some embodiments, the disconnector 42 comprises an engaging portion 44 and the hammer 30 comprises a catch 34. In some embodiments, the engaging portion 44 engages the catch 34 and the disconnector 42 prevents movement of the hammer 30 until the engaging portion 44 is released from the catch 34.

In some embodiments, the safety mechanism 18 is moveable with respect to the housing 8. In some embodiments, the safety mechanism 18 comprises a portion oriented outside of the housing 8, such as a safety lever 70, which can be operated by a user to engage or disengage the safety mechanism 18. In some embodiments, the safety mechanism 18 is moveable with respect to a portion of the fire control mechanism 10, such as the trigger 20. In some embodiments, the safety mechanism 18 is arranged to move about a safety axis 19. In some embodiments, the safety mechanism 18 comprises an interference portion 72 arranged to prevent operation of the fire control mechanism 10. In some embodiments, the safety mechanism 18 is moveable between a first position and a second position. In some embodiments, in the first position, the safety mechanism 18 prevents operation of the fire control mechanism 10. In some embodiments, in the second position, the safety mechanism does not impede operation of the fire control mechanism 10. In some embodiments, the trigger 20 comprises a safety interface portion 28 arranged to contact the safety mechanism 18. In some embodiments, in the first position, the interference portion 72 of the safety mechanism 18 contacts the safety interface portion 28 of the trigger 20 and prevents operation of the trigger 20.

In some embodiments, a size of the interference portion 72 of the safety mechanism 18 is adjustable. In some embodiments, a radial distance that the interference portion 72 extends from the safety axis 19 is adjustable.

FIG. 2 shows an embodiment of a safety mechanism 18. In some embodiments, the safety mechanism 18 is arranged to rotate about the safety axis 19. In some embodiments, the safety mechanism 18 comprises a first supported portion 76 and a second supported portion 78. In some embodiments, the first supported portion 76 is supported by a first portion of the housing 8 (see FIG. 1) and the second supported portion 78 is supported by a second portion of the housing 8. In some embodiments, the safety mechanism 18 is rotatably supported by the housing 8 at the first supported portion 76 and the second supported portion 78.

In some embodiments, the safety mechanism 18 comprises a second portion 73 moveable with respect to a first portion 71. In some embodiments, the first portion 71 comprises the supported portion(s) 76, 78 and the second portion 73 comprises the interference portion 72. In some embodiments, movement of the second portion 73 with respect to the first portion 71 changes a specific location of the interfering portion 72. In some embodiments, movement of the second portion 73 with respect to the first portion 71 adjusts a radial distance from the safety axis 19 to the interference portion 72.

In some embodiments, the second portion 73 and/or the interference portion 72 comprises a threaded portion 74. In some embodiments, the first portion 71 comprises a cavity 79 arranged to receive the second portion 73. In some embodiments, the cavity 79 comprises complimentary threads arranged to engage the threaded portion 74. In some embodiments, the second portion 73 comprises a tool interface 75 to allow the second portion 73 to be manipulated by a drive tool. In some embodiments, a tool interface 75 comprises any suitable known drive tool interface such as Allen screw, Philips, Torx, ect. In some embodiments, the first portion 71 comprises a bore 77 in fluid communication with the cavity 79. In some embodiments, the bore 77 allows the second portion 73 to be adjusted with respect to the first portion 71 using a drive tool that extends through the first portion 71 and engages the second portion 73. This allows the second portion 73 to be manipulated while the fire control mechanism 10 is installed in a housing 8.

Figure 3:
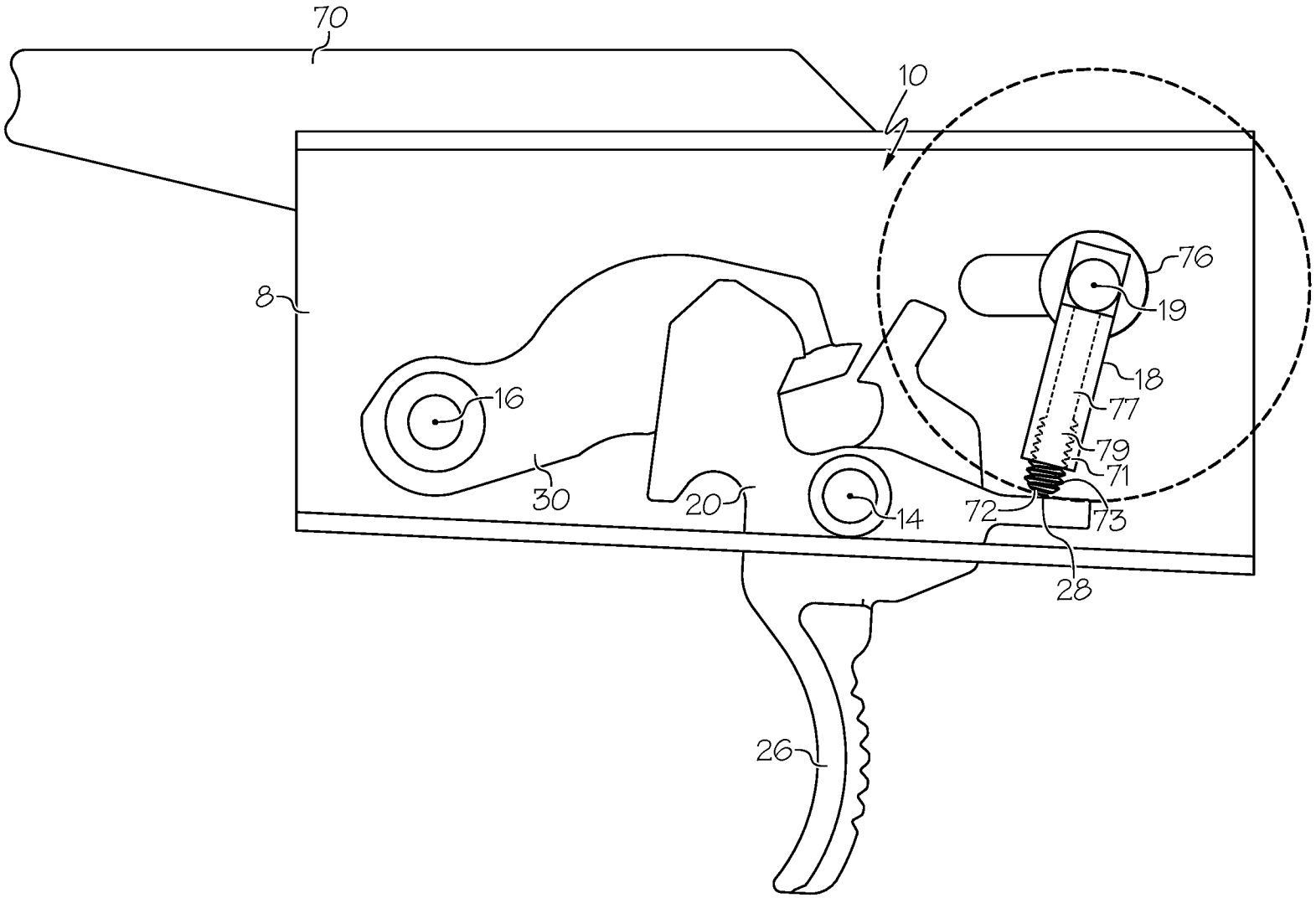
FIG. 3 shows an embodiment of a safety mechanism with other components of a fire control mechanism.

FIG. 3 shows an embodiment of a safety mechanism 18 in a first position and arranged to impede operation of the trigger 20. The specific position of the interference portion 72 is adjustable to improve fitment of the components.

Figure 4:
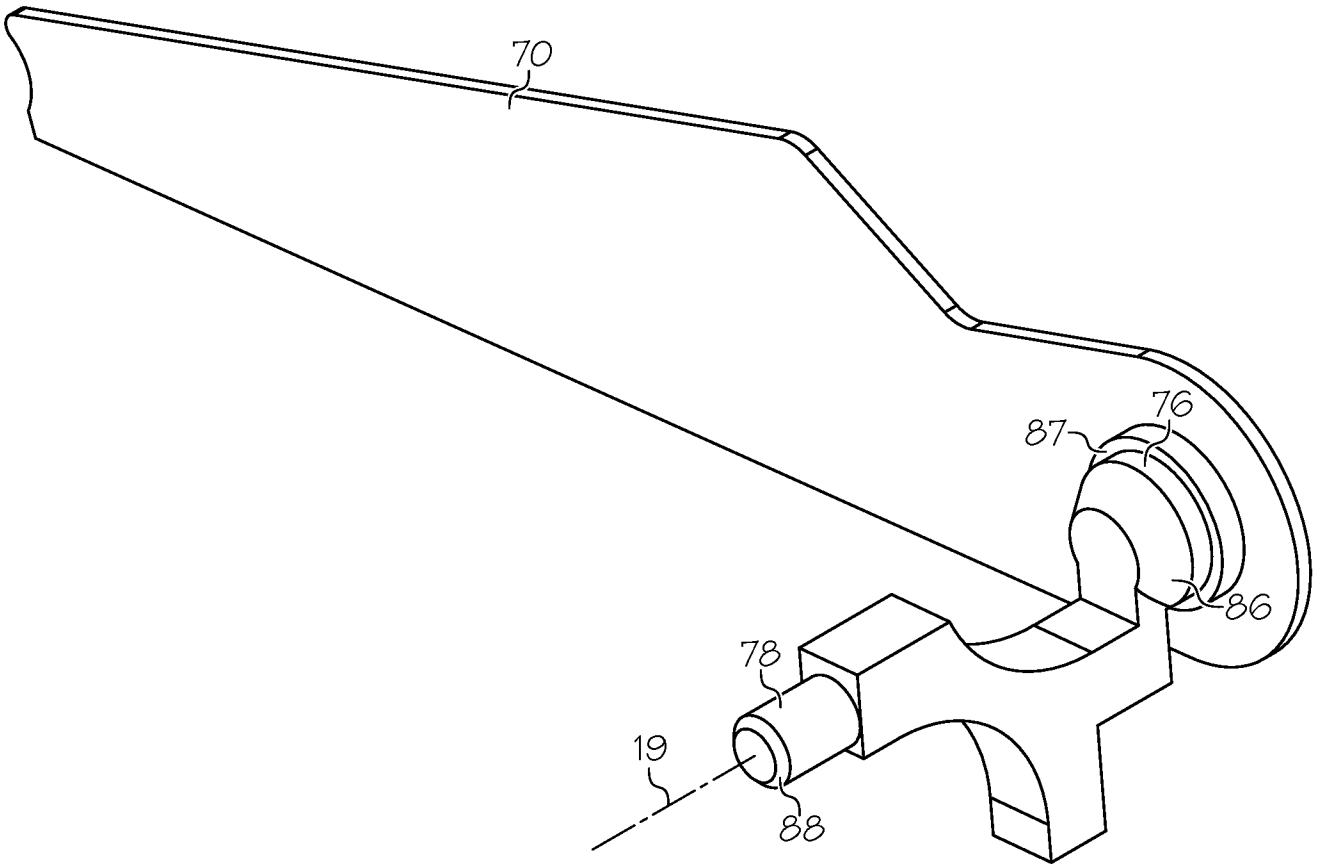
FIG. 4 shows another embodiment of a safety mechanism.
Figure 5B:
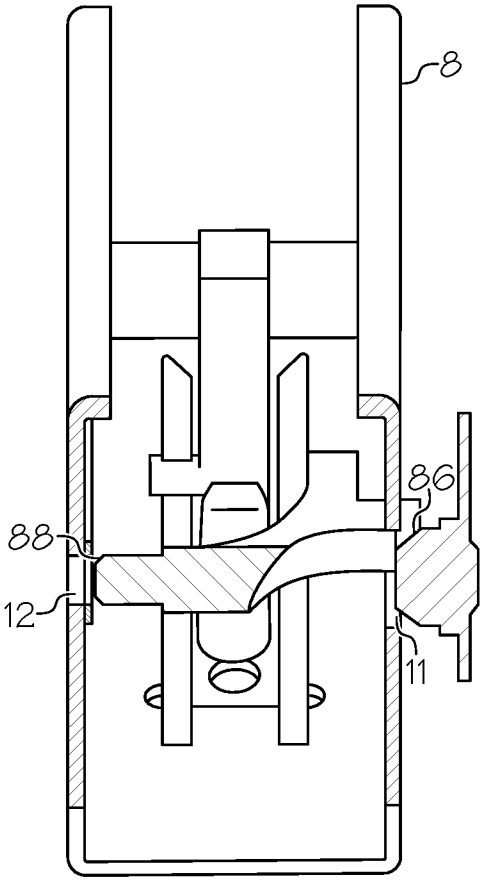
FIG. 5 shows the safety mechanism of FIG. 4 during an installation procedure.
Figure 5A:
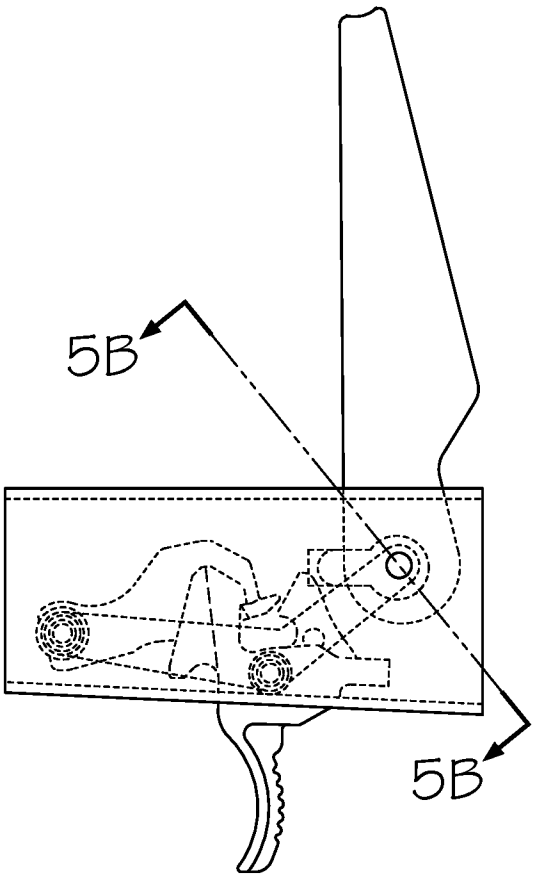
Figure 6B:
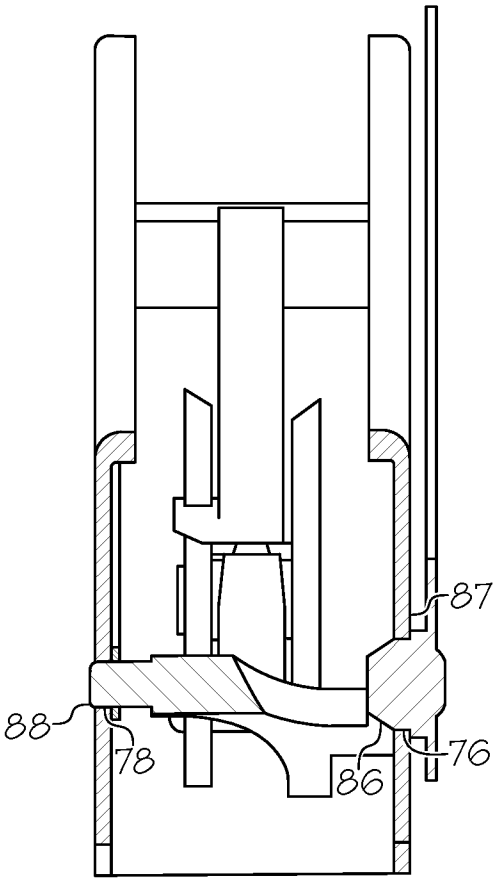
FIG. 6 shows the safety mechanism of FIG. 4 in an installed configuration.
Figure 6A:
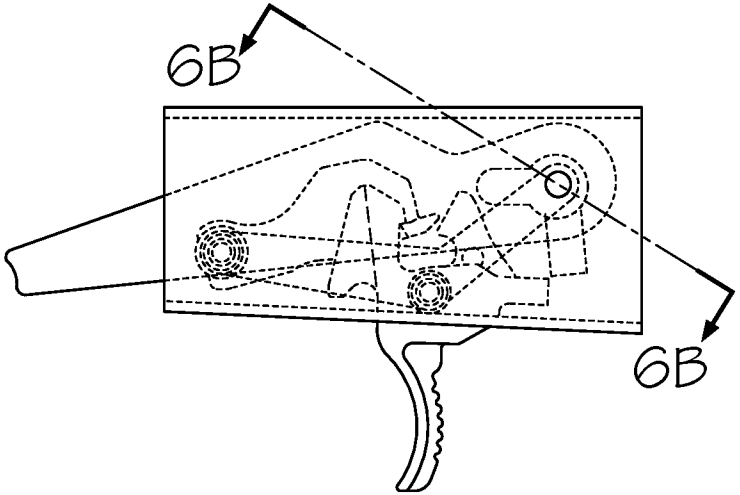

FIGS. 4-6 show another embodiment of a safety mechanism 18. In some embodiments, a safety mechanism 18 comprises a bevel 86 located adjacent to a supported portion 76. In some embodiments, a bevel 86 comprises a surface oriented at a non-orthogonal angle to the safety axis 19. In some embodiments, a bevel 86 comprises a conical surface. In some embodiments, a bevel 86 comprises a smaller cross-sectional size than the supported portion 76.

In some embodiments, a safety mechanism 18 comprises a first bevel 86 located adjacent to a first supported portion 76 and a second bevel 88 located adjacent to a second supported portion 78.

In some embodiments, a safety mechanism 18 comprises a flange 87 located adjacent to the first supported portion 76. In some embodiments, a bevel 86 and a flange 87 are located on opposite sides of a supported portion 76.

FIG. 5 shows an embodiment of a safety mechanism 18 during installation. In some embodiments, a housing 8 comprises a first aperture 11 and a second aperture 12. In some embodiments, the first aperture 11 comprises a first support for the safety mechanism 18 and the second aperture 12 comprises a second support for the safety mechanism 18. In some embodiments, the first bevel 86 comprises a smaller size than the first aperture 11 and the second bevel 88 comprises a smaller size than the second aperture 12. In some embodiments, the first bevel 86 and the second bevel 88 encourage supported portions 76, 78 of the safety mechanism 18 to self-align with the support apertures 11, 12.

FIG. 6 shows an embodiment of a safety mechanism 18 in an installed configuration. In some embodiments, the flange 87 abuts a sidewall of the housing 8 when the safety mechanism 18 is installed in a housing 8.

In some embodiments, a bevel 86, 88 protrudes from a sidewall of the housing 8 when the safety mechanism 18 is installed in the housing 8. In some embodiments, the first bevel 86 is located within an interior cavity of the housing 8. In some embodiments, the second bevel 88 protrudes from an external surface of a sidewall of the housing 8. In some embodiments, the second bevel 88 is located outside of the housing 8.

Figure 7:
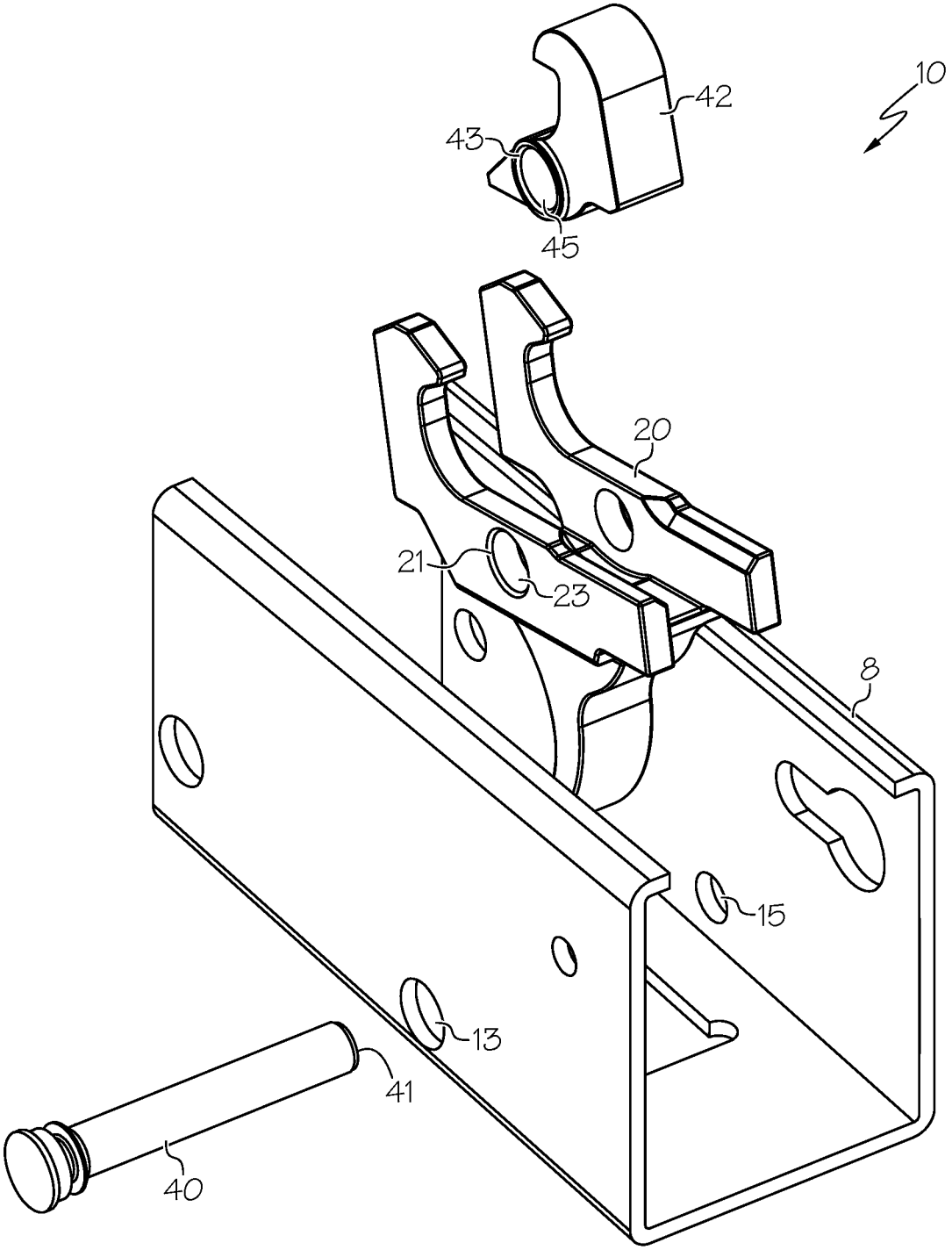
FIG. 7 shows another embodiment of a fire control mechanism.
Figure 8B:
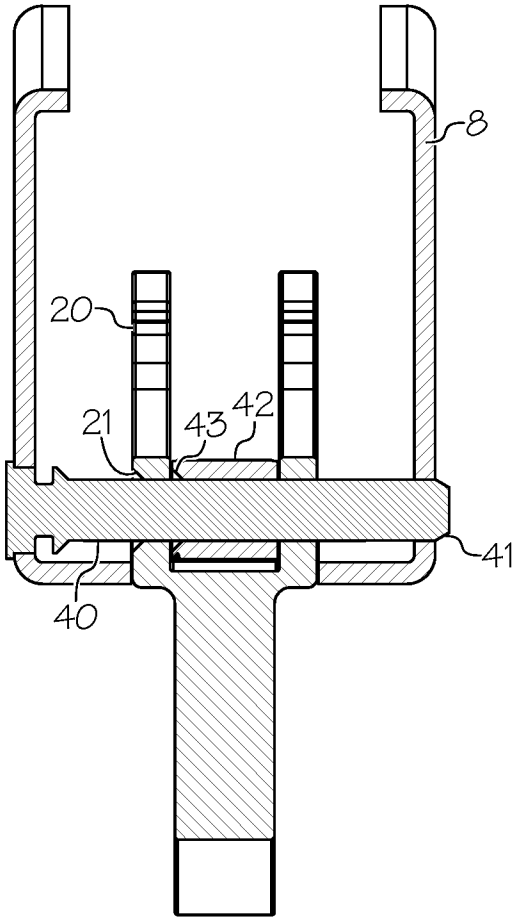
FIG. 8 shows a cross-sectional view of components shown in FIG. 7.
Figure 8A:
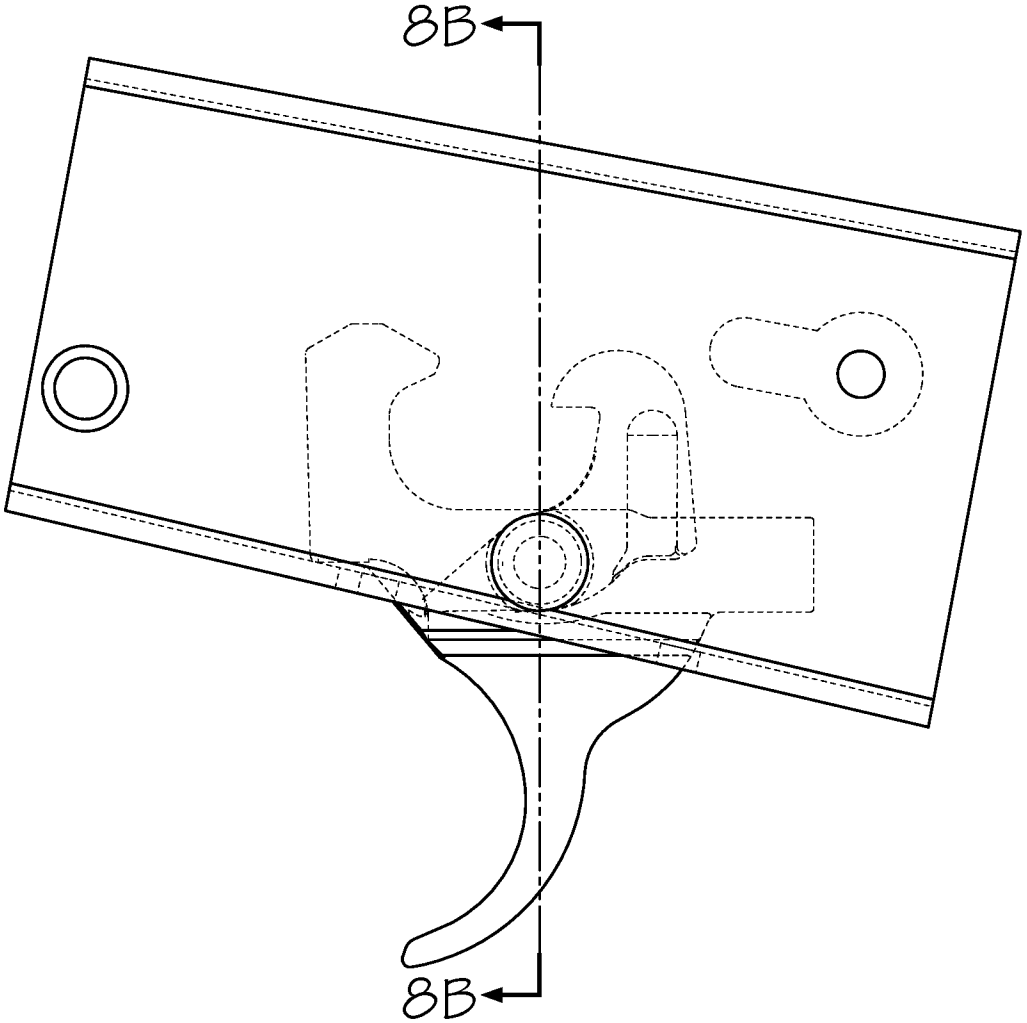

FIGS. 7 and 8 show components of another embodiment of a fire control mechanism 10. In some embodiments, a trigger 20 and a disconnector 42 are supported by a trigger pin 40. In some embodiments, the trigger pin 40 is supported by the housing 8. In some embodiments, the housing 8 comprises a first aperture 13 and a second aperture 15 arranged to receive and support the trigger pin 40.

In some embodiments, the trigger pin 40 extends through and supports the trigger 20. In some embodiments, the trigger pin 40 extends through and supports the disconnector 42.

In some embodiments, the trigger pin 40 comprises a bevel 41. In some embodiments, the bevel 41 is located at an end of the trigger pin 40.

In some embodiments, the trigger 20 comprises a bevel 21 located adjacent to an aperture 23 arranged to receive the trigger pin 40. In some embodiments, the bevel 21 in the trigger 20 and the bevel 41 on the trigger pin 40 encourage the trigger pin 40 to self-align with the aperture 23 in the trigger 20.

In some embodiments, the disconnector 42 comprises a bevel 43 adjacent to an aperture 45 arranged to receive the trigger pin 40. In some embodiments, the bevel 43 in the disconnector 42 and the bevel 41 on the trigger pin 40 encourage the trigger pin 40 to self-align with the aperture 45 in the disconnector 42.

FIG. 8 shows a cross-sectional view of components shown in FIG. 7. In some embodiments, the trigger pin 40 contacts the trigger 20. In some embodiments, the fire control mechanism 10 excludes a sleeve oriented between the trigger pin 40 and the trigger 20. In some embodiments, the trigger pin 40 contacts the disconnector 42. In some embodiments, the fire control mechanism 10 excludes a sleeve oriented between the trigger pin 40 and the disconnector 42.

In some embodiments, the trigger pin 40 extends from both sides of the housing 8 when the trigger pin 40 is installed in the housing 8. In some embodiments, the bevel 41 of the trigger pin 40 extends outside of the sidewall of the housing 8.

In some embodiments, the hammer 30 is supported by a hammer pin (not shown) that is similar to the trigger pin 40. In some embodiments, the hammer pin contacts the hammer 30. In some embodiments, the hammer pin excludes a sleeve oriented between the hammer pin and the hammer 30.

Figure 9:
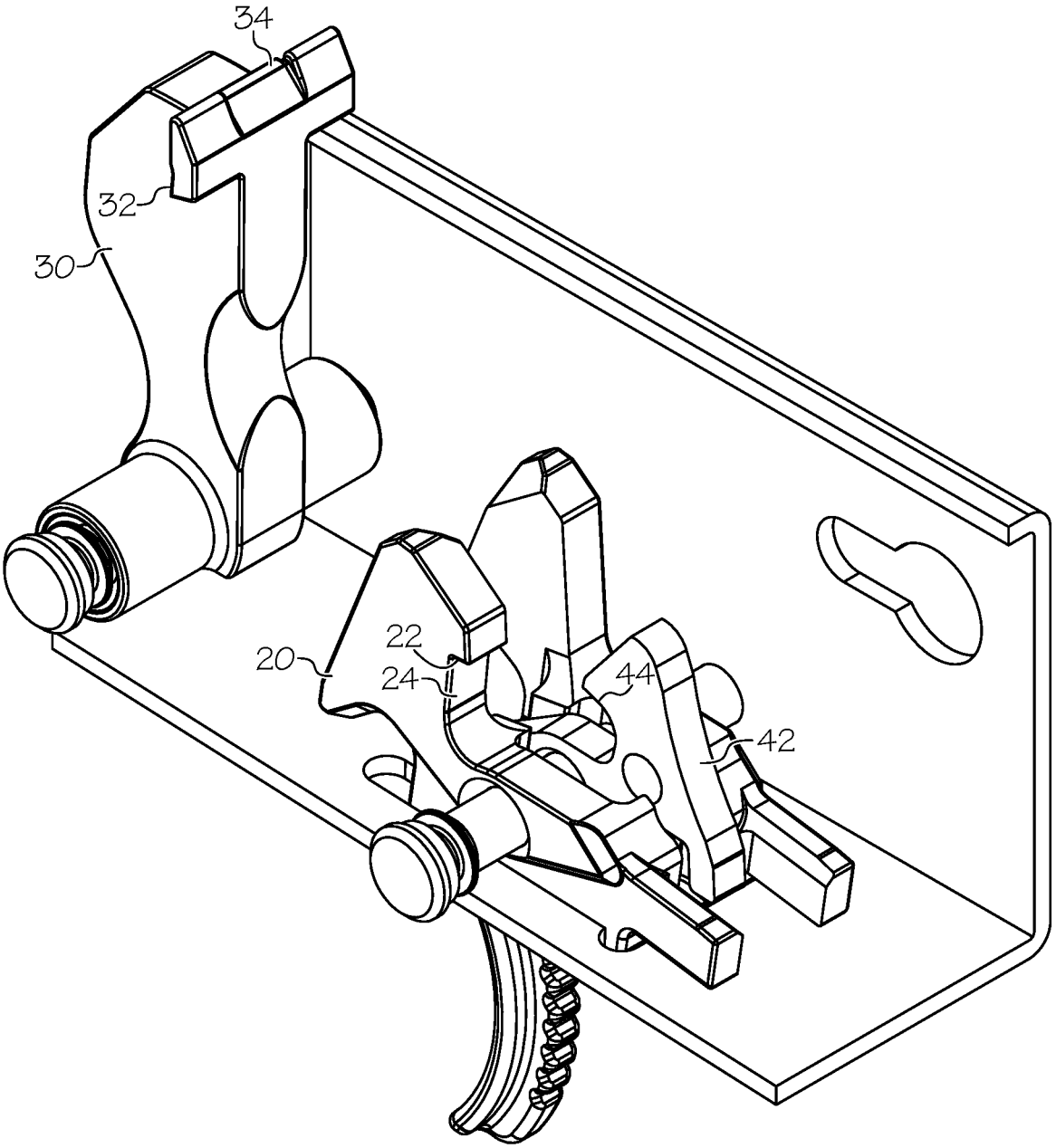
FIG. 9 shows another embodiment of a fire control mechanism.

FIG. 9 shows another embodiment of a fire control mechanism 10. In some embodiments, the hammer 30 comprises a hammer sear 32 and the trigger 20 comprises a trigger sear 22. In some embodiments, the hammer sear 32 and trigger sear 22 are arranged to contact one another in some orientations of the fire control mechanism 10. In some embodiments, the hammer 30 comprises a catch 34 arranged to engage an engaging portion 44 of the disconnector 42 in some orientations of the fire control mechanism 10.

In some embodiments, the trigger 20 comprises a ramp surface 24 located adjacent to the trigger sear 22.

Figure 10:
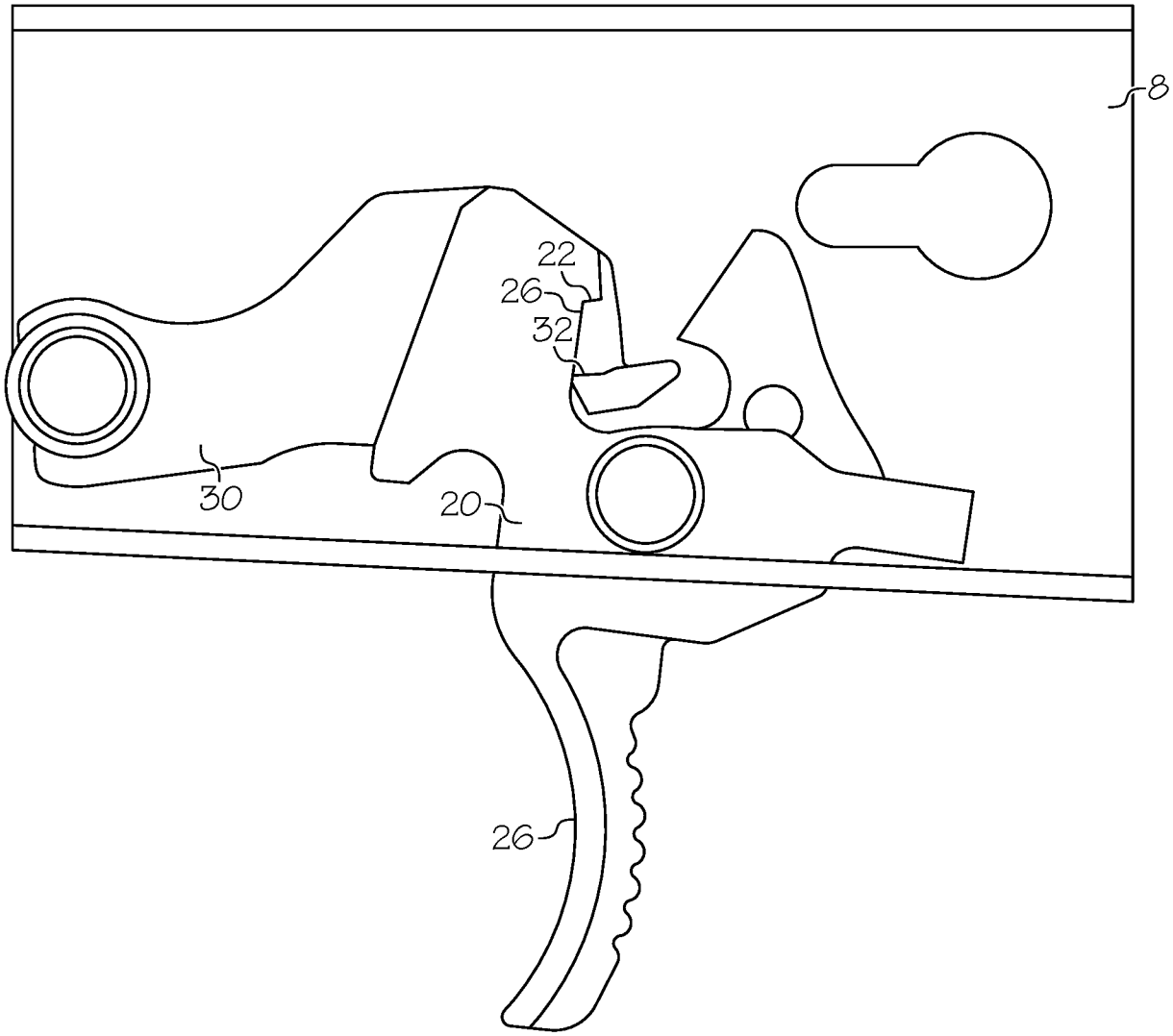
FIG. 10 shows the fire control mechanism of FIG. 9 during a cocking operation.

FIG. 10 shows the fire control mechanism 10 of FIG. 9 during a cocking operation prior to firing any rounds. For example, a user is not applying any force to the finger bow 26 of the trigger 20. In some embodiments, a leading edge of the hammer sear 32 contacts the ramp 24 of the trigger 20.

Figure 11:
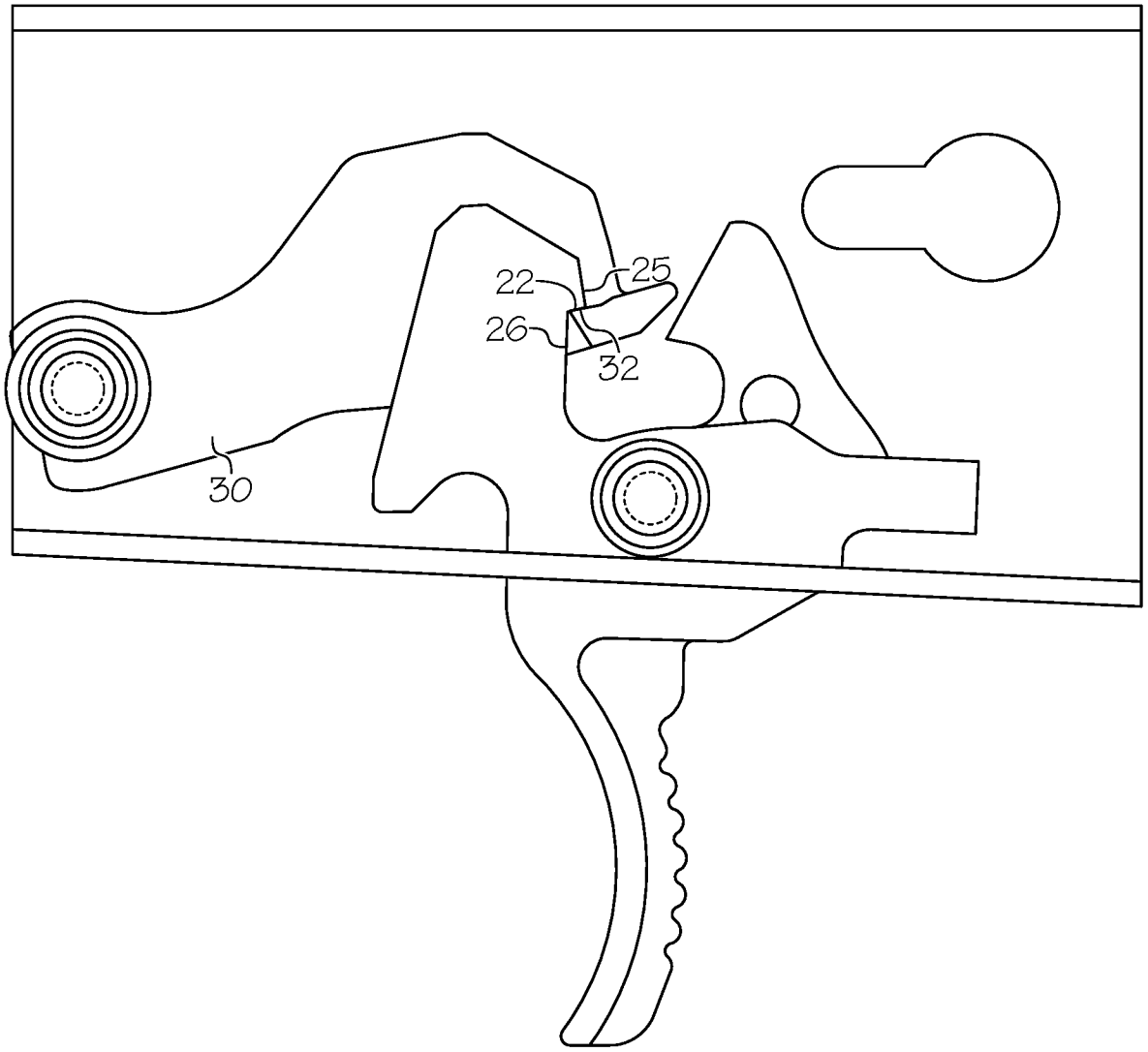
FIG. 11 shows the fire control mechanism of FIG. 9 in a ready-to-fire orientation.

FIG. 11 shows the components of FIG. 10 in a ready-to-fire orientation. From the orientation shown in FIG. 10, the fire control mechanism 10 will assume a ready-to-fire orientation due to traditional biasing forces on the hammer and trigger provided by hammer and trigger rotation springs (not shown). Under such biasing forces, the leading edge of the hammer sear 32 will traverse up the ramp 26 until the hammer sear 32 contacts and seats against the trigger sear 22.

In some embodiments, a dimension of the trigger sear 22 (e.g. between a first end of the sear 22 at the ramp 26 and a second end of the sear 22 at a break edge 25) will set the amount of creep experienced during trigger pull. In some embodiments, an edge of the hammer sear 32 is directly adjacent to the ramp 26 when the fire control mechanism 10 is in a ready-to-fire orientation.

Figure 12:
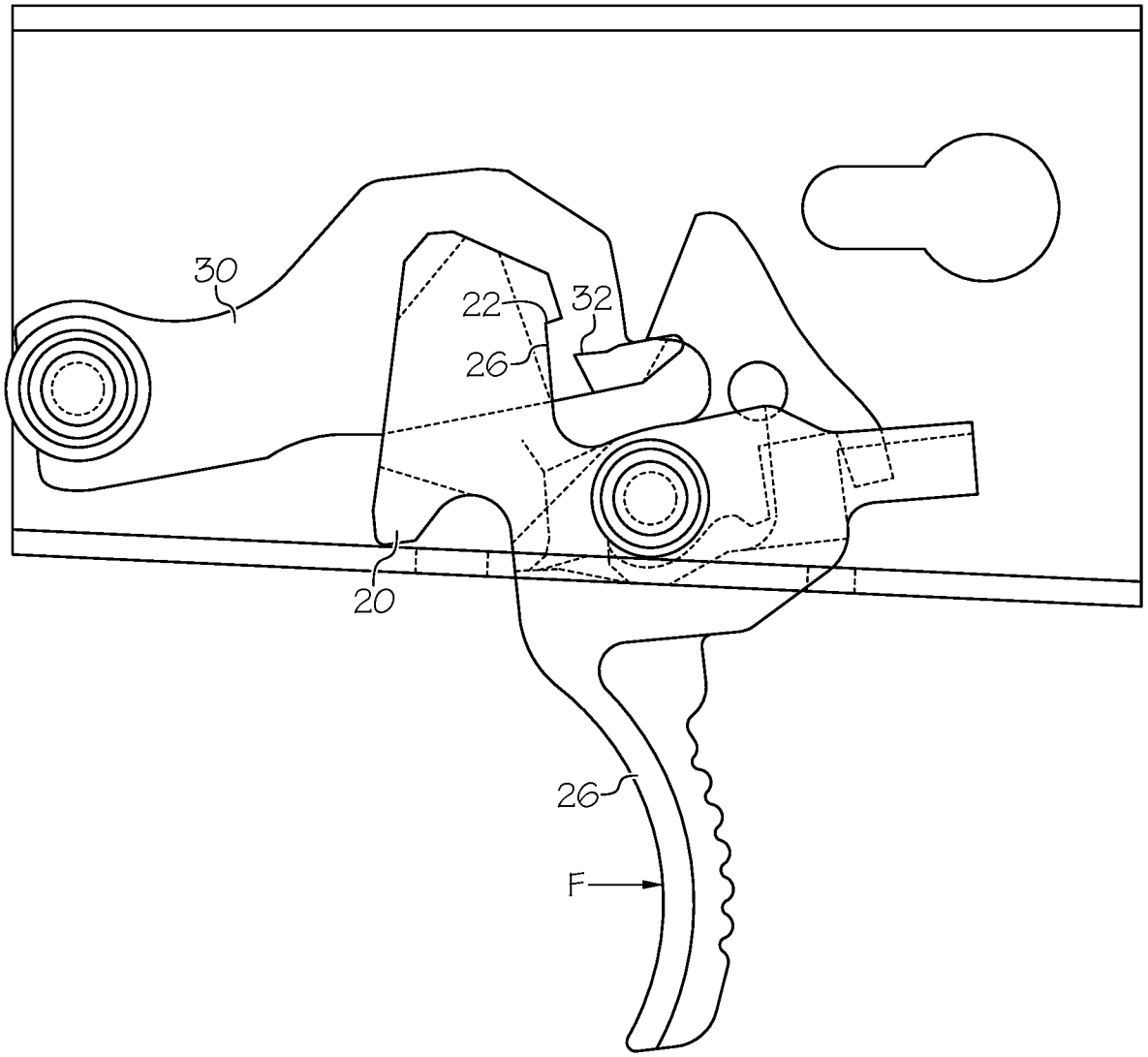
FIG. 12 shows the fire control mechanism of FIG. 9 after a round has been fired.
Figure 13:
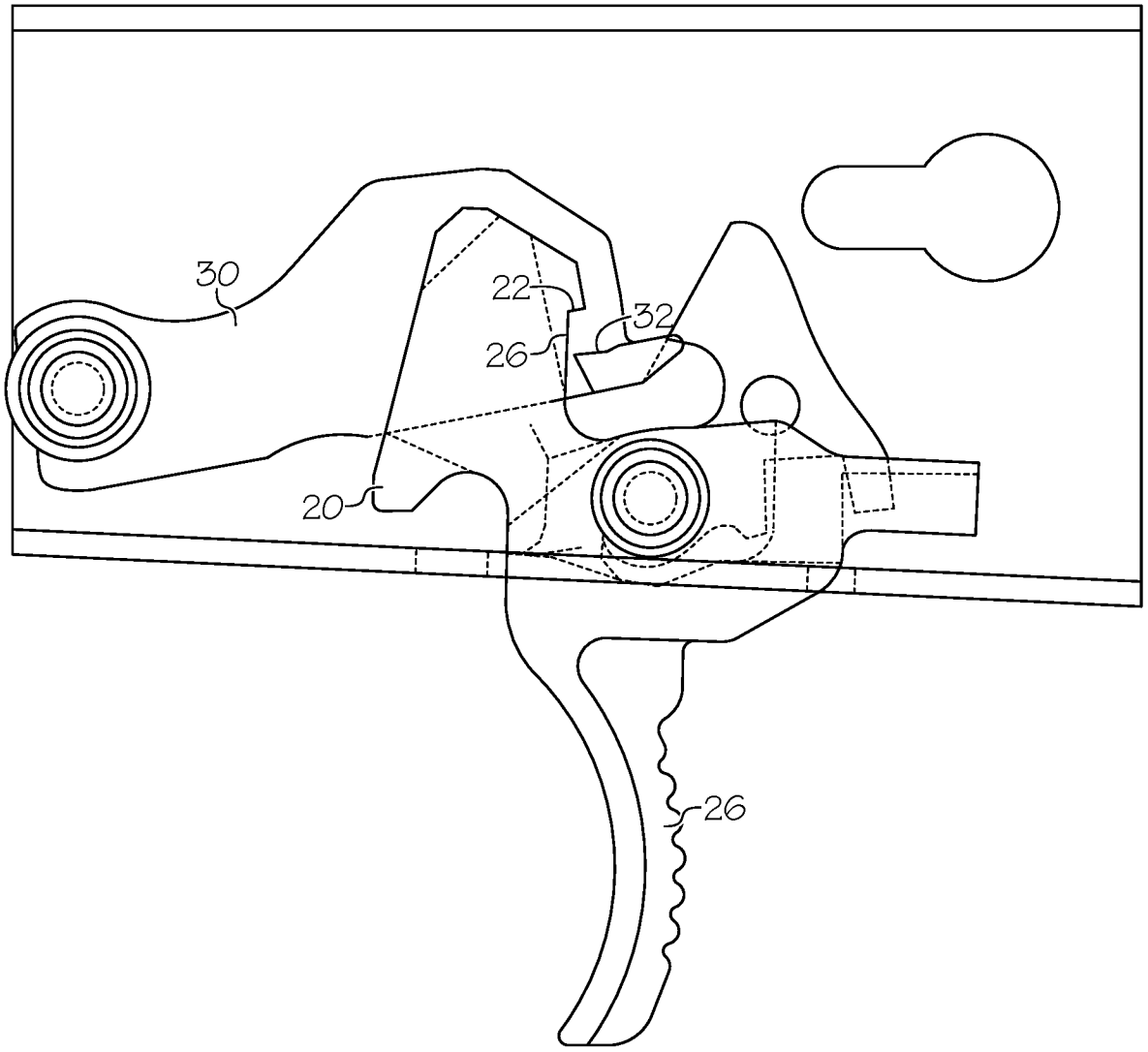
FIG. 13 shows the fire control mechanism of FIG. 9 during a reset.

FIG. 12 shows the components of FIG. 10 during another stage of operation. After firing a round, while a user is still applying force F to the finger bow 26 of the trigger 20, the disconnector 42 will capture the hammer 30. As the force F is released, as shown in FIG. 13, the trigger 20 and disconnector 42 will rotate and the disconnector 42 will eventually release the hammer 30. Under traditional biasing forces provided by hammer and trigger rotation springs (not shown), the hammer sear 32 will contact and seat against the trigger sear 22. In some embodiments, a leading edge of the hammer sear 32 will traverse up the ramp 26 prior to the sears 22, 32 contacting one another.

In some embodiments, a reference line extending orthogonal to the trigger sear 22 is oriented between the hammer axis 16 and the trigger axis 14.

In some embodiments, an angle between the trigger sear 22 and the ramp 26 is less than 120 degrees. In some embodiments, the angle is less than 115 degrees. In some embodiments, the angle is les than 110 degrees.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A fire control mechanism comprising:

a hammer rotatable about a hammer axis;

a trigger rotatable about a trigger axis, the trigger arranged to contact the hammer, the trigger comprising a first side portion and a second side portion defining a central cavity;

a disconnector oriented in the central cavity; and a safety arranged to interfere with rotation of the trigger, the safety comprising a second portion moveable with respect to a first portion, the first portion comprising a lever, the second portion arranged to contact the first side portion of the trigger.

2. The fire control mechanism of claim 1, the safety arranged to rotate about a safety axis.

3. The fire control mechanism of claim 2, wherein a distance between the safety axis and the second portion changes as the second portion is moved with respect to the first portion.

4. The fire control mechanism of claim 1, the second portion comprising screw threads.

5. The fire control mechanism of claim 4, the first portion comprising a threaded cavity.

6. The fire control mechanism of claim 1, the second portion comprising a set screw.

7. The fire control mechanism of claim 1, the first portion comprising a bore, the bore providing access to the second portion.

8. The fire control mechanism of claim 1, the safety comprising a supported portion, the safety comprising a bevel adjacent to the supported portion.

9. The fire control mechanism of claim 8, the bevel comprising a cross-section smaller than a cross-section of the supported portion.

10. The fire control mechanism of claim 9, the supported portion and the bevel sharing an edge.

11. The fire control mechanism of claim 8, the safety comprising a flange adjacent to the supported portion.

12. The fire control mechanism of claim 11, the flange comprising a cross- section larger than a cross-section of the supported portion.

13. The fire control mechanism of claim 12, the bevel and flange located on opposite sides of the supported portion.

14. The fire control mechanism of claim 8, the supported portion comprising a first supported portion, the safety comprising a second supported portion and a second bevel adjacent to the second supported portion.

15. The fire control mechanism of claim 14, comprising a housing arranged to support the first supported portion and the second supported portion, the second bevel oriented outside the housing.

16. The fire control mechanism of claim 1, further comprising a disconnector rotatable about the trigger axis; and a trigger pin arranged to support the trigger and the disconnector, the trigger pin comprising a bevel.

17. The fire control mechanism of claim 16, the bevel located at an end of the trigger pin.

18. The fire control mechanism of claim 16, the trigger pin contacting the trigger.

19. The fire control mechanism of claim 1, the second portion rotatable with respect to the first portion.

20. The fire control mechanism of claim 1, the second portion comprising a tool interface.

* * * * *